US010683698B2

(12) United States Patent
Dintheer et al.

(10) Patent No.: US 10,683,698 B2
(45) Date of Patent: Jun. 16, 2020

(54) HINGE-SIDED FINGER PROTECTION DEVICE

(71) Applicant: Planet GDZ AG, Tagelswangen (CH)

(72) Inventors: Andreas Dintheer, Illnau (CH); Andreas Brändle, Hettlingen (CH)

(73) Assignee: PLANET GDZ AG, Tagelswangen (CH)

( * ) Notice: Subject to any disclaimer, the term of this patent is extended or adjusted under 35 U.S.C. 154(b) by 169 days.

(21) Appl. No.: 15/756,184

(22) PCT Filed: Jul. 26, 2016

(86) PCT No.: PCT/EP2016/067765

§ 371 (c)(1),
(2) Date: Feb. 28, 2018

(87) PCT Pub. No.: WO2017/036678

PCT Pub. Date: Mar. 9, 2017

(65) Prior Publication Data

US 2018/0274287 A1 Sep. 27, 2018

(30) Foreign Application Priority Data

Aug. 31, 2015 (EP) ..... 15183124

(51) Int. Cl.
*E06B 7/36* (2006.01)
*E06B 7/23* (2006.01)

(52) U.S. Cl.
CPC ..... *E06B 7/367* (2013.01); *E06B 7/2305* (2013.01); *E06B 7/2309* (2013.01); *E06B 7/36* (2013.01);

(Continued)

(58) Field of Classification Search
CPC ..... E06B 7/367; E06B 7/36; E06B 7/2309; E06B 7/2305; Y10T 24/304; Y10T 24/306; Y10T 24/307

(Continued)

(56) References Cited

U.S. PATENT DOCUMENTS 2,610,377 A 9/1952 Bedford, Jr.
2,694,234 A * 11/1954 Roby ..... E06B 7/367 49/383

(Continued)

FOREIGN PATENT DOCUMENTS

CN 202745661 U 2/2013
DE 7131398 U 4/1972

(Continued)

OTHER PUBLICATIONS

FR2783555_translation.pdf.*

*Primary Examiner* — Marcus Menezes
(74) *Attorney, Agent, or Firm* — Browdy and Neimark, P.L.L.C.

(57) ABSTRACT

The invention relates to a hinge-sided finger protection device for a wing door, comprising at least a protective profile (1) and at least a fastening means (3) for fastening the protective profile (1) to a door frame (R) of the wing door. The protective profile (1) can be plugged onto the fastening means (3), wherein the protective profile (1) accommodates in itself the fastening means (3) in the plugged-on state. The protective profile (1) is non-destructively removable from the fastening means (3) and can be again plugged thereon. The at least one fastening means is preferably a clip (3).

7 Claims, 5 Drawing Sheets

(52) U.S. Cl.
CPC ..... *Y10T 24/304* (2015.01); *Y10T 24/306* (2015.01); *Y10T 24/307* (2015.01)

(58) Field of Classification Search
USPC ..... 49/383
See application file for complete search history.

(56) References Cited

U.S. PATENT DOCUMENTS 2,787,033 A * 4/1957 Peckham ..... B60J 10/80 49/492.1
2,910,741 A * 11/1959 Dettman ..... E06B 7/367 49/383
2,935,770 A * 5/1960 Gagnier ..... F16B 5/125 49/492.1
2,995,785 A * 8/1961 Hallenbeck ..... E06B 7/367 49/383
3,673,643 A * 7/1972 Kindell ..... F16B 2/241 24/458
4,538,381 A * 9/1985 Vogel ..... F24C 15/021 49/479.1
4,911,971 A * 3/1990 McCue ..... E04F 19/026 24/293
4,920,714 A * 5/1990 Sease ..... B44C 7/022 160/392
5,096,753 A * 3/1992 McCue ..... A47B 95/043 24/293
5,353,571 A * 10/1994 Berdan ..... B60R 13/04 24/293
6,477,809 B1 11/2002 Dorner et al.
7,786,884 B1 8/2010 McRoskey
9,682,765 B2 * 6/2017 Paul ..... E06B 7/2305
2005/0060939 A1 * 3/2005 Stout, Jr. ..... E06B 7/367 49/383
2005/0066583 A1 * 3/2005 Newcombe ..... E06B 7/367 49/462
2005/0108946 A1 * 5/2005 Shaharbani ..... E06B 7/367 49/383
2005/0155291 A1 7/2005 Homolka et al.
2006/0101617 A1 * 5/2006 Webb ..... E06B 7/367 16/250

FOREIGN PATENT DOCUMENTS

DE 3716654 A1 12/1988
DE 20008650 U1 8/2000
FR 2726317 A1 * 5/1996 ..... E06B 7/367
FR 2783555 A1 * 3/2000 ..... E06B 7/36
FR 2783555 A1 3/2000

* cited by examiner

HINGE-SIDED FINGER PROTECTION DEVICE

TECHNICAL FIELD

The present invention relates to a hinge-sided finger protection device for a leaf door.

PRIOR ART

Doors carry a high risk of accidents, in particular for small children. It is a frequent occurrence for fingers to be trapped in the gap between the door leaf and the door frame. The forces acting on the trapped fingers are high, and the resulting injury is severe.

Devices are known from the prior art, therefore, which are intended to provide protection to the fingers from being inadvertently trapped. In this case, finger protection devices for the secondary closing edges of the leaf door on the hinge side and on the opposing hinge side are known.

The hinge side is that side of the door leaf on which the door hinge, i.e. the door hinge, is arranged. The opposing hinge side is located on the side of the door leaf opposing said door hinge. The lock side of the door leaf is located at the other end of the door, namely next to the door lock and next to the door latch.

In DE 37 16 654 the use of a roller blind is proposed for covering the gap on the opposing hinge side. The hinge side is protected by means of cover strips which are bonded between the door hinges to the door frame.

It is also known from the prior art to screw-on such cover strips or to produce them as protective profiles made of metal and to clip them onto plastic holders. If it is necessary to take a door leaf off its hinges, for example when moving house or for renovation, these finger protection devices are only able to be removed with great difficulty.

DESCRIPTION OF THE INVENTION

It is, therefore, an object of the invention to provide an improved hinge-sided finger protection device.

The hinge-sided finger protection device according to the invention for a leaf door comprises at least one protective profile and at least one fastening means for fastening the protective profile to a door frame of the leaf door. The protective profile can be plugged onto the fastening means, wherein the protective profile accommodates in itself the fastening means in the plugged-on state, wherein the protective profile receives said fastening means preferably entirely therein and/or fully covers said fastening means. According to the invention, the protective profile is non-destructively removable from the fastening means and can be again plugged thereon.

Since the protective profile may be released in a simple non-destructive manner from the fastening means, the use of the finger protection device is simplified. The finger protection device may be removed at any time which permits a rapid and thus cost-effective operation, in particular when mounting the doors or during renovation. The release is preferably carried out by hand and, in particular, without the use of special tools.

It is also advantageous that the protective profile may have a relatively simple shape, so that its production is cost-effective. The protective profile may additionally be constructed according to the desired design of the architect and thus configured to be visually attractive. The appearance of the door is not impaired by this finger protection device.

In a preferred embodiment, the at least one fastening means is a clip, in particular a resilient clip. In alternative embodiments, the protective profile comprises an internal space for receiving the at least one fastening means and a clip in this internal space for connecting to the at least one fastening means.

The clip itself is preferably screwed to the door.

Preferably, the clip is configured to be axially symmetrical in cross section. This simplifies the production and the mounting.

In a preferred embodiment, the clip has a planar base which on two opposing sides transitions into one respective first limb, wherein each first limb transitions into an inwardly extending receiver recess, and wherein each receiver recess transitions into a second limb terminating freely. The clip may be fastened to the door frame in a simple manner due to the planar base. The receiver recesses may be forced inwardly due to the first and second limb when plugging on the protective profile, wherein due to the shape of the clip they exert a counter-pressure on the protective profile and thus hold the protective profile in its position. By tilting the protective profile slightly to the side, this protective profile may be released from the clip. The first and second limbs preferably extend obliquely, i.e. at an angle not at 90° to the base.

The resilient action and the simplification of the release of the protective profile are increased when the two first limbs open obliquely outwardly from the base. The same applies when the two second limbs are inclined obliquely inwardly toward a longitudinal central axis.

Preferably, the two receiver recesses are arranged at the same height relative to the base. This also simplifies the mounting and the removal of the protective profile.

The clip is preferably configured to be thin. Preferably it is produced from a metal, preferably from spring steel.

The protective profile is preferably configured to be axially symmetrical in cross section. This reduces the production costs and simplifies the mounting.

Preferably, the protective profile has two inwardly protruding ribs for engaging in the receiver recesses. This is a simple and cost-effective design. If the ribs are configured to be linear in their extent and/or extend at an angle of 90° from the side walls of the protective profile, the introduction into the receiver recesses is simplified. Preferably, the ribs extend over the entire length of the protective profile. However, the ribs may also be present only in regions, namely where the clips are likely to come to rest in the mounted state. The ribs are preferably integrally configured with the remaining protective profile. They may also be configured, however, as elements which are able to be fastened to the protective profile.

Preferably, the protective profile is produced from metal or plastics material. The protective profile is preferably configured to be approximately stiff or stiff.

In a preferred embodiment, the protective profile has two opposing limbs terminating freely. Preferably, these limbs protrude over the ribs and thus cover the lower region of the clip in the vicinity of the door frame.

Preferably, the limbs have free ends which have one respective chamfer, which is inclined toward the base or thinned, a tapering or a step. This simplifies the removal of the protective profile by means of a tool, for example a screwdriver.

Further embodiments are disclosed in the dependent claims.

BRIEF DESCRIPTION OF THE DRAWINGS

A preferred embodiment of the invention is described hereinafter with reference to the drawings, which merely serve for the description and are not to be understood as limiting. In the drawings.

DESCRIPTION OF PREFERRED EMBODIMENTS

Figure 1:
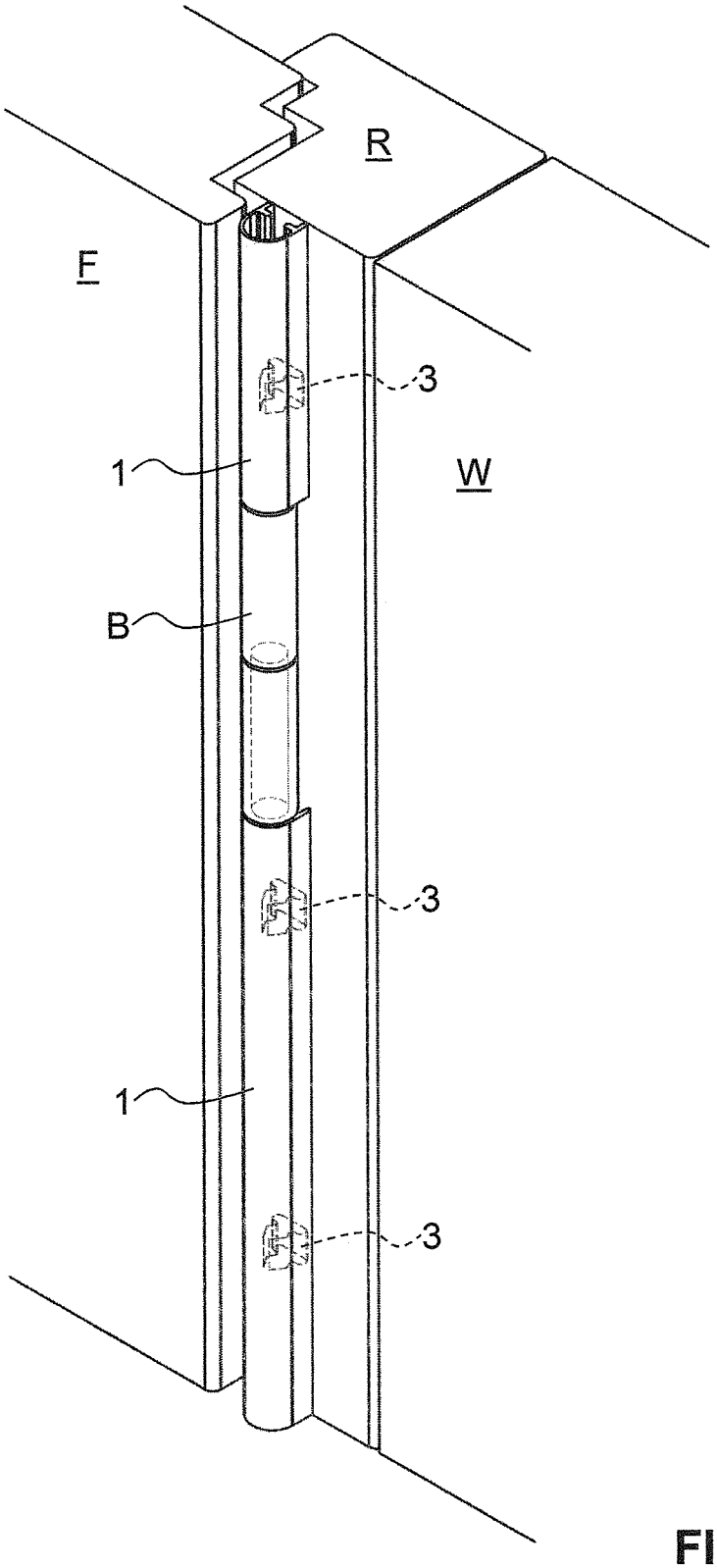
FIG. 1 shows a perspective view of a part of a leaf door with a hinge-sided finger protection device according to the invention.
Figure 2:
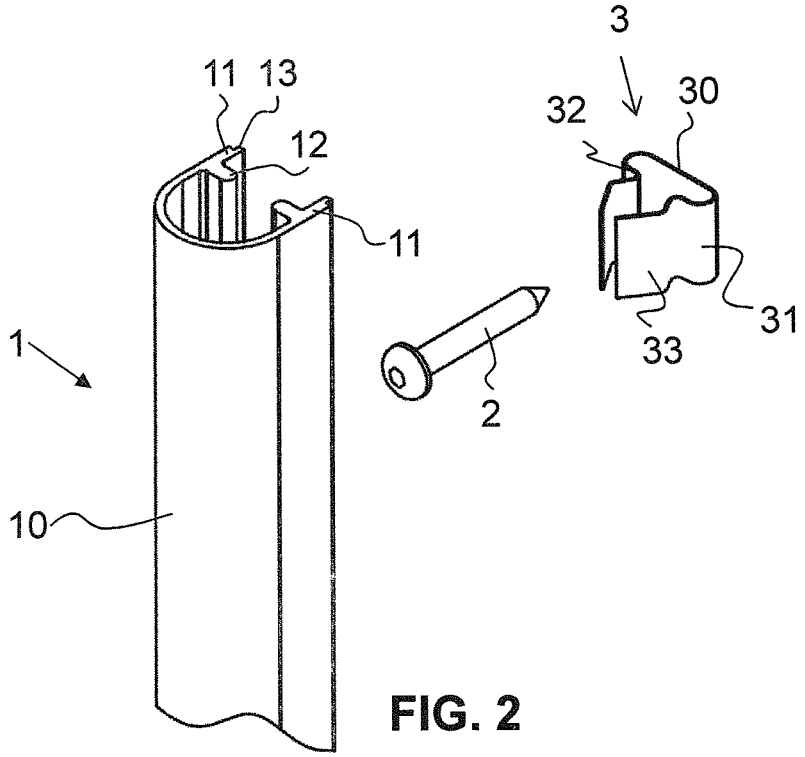
FIG. 2 shows an exploded view of a part of the finger protection device according to the invention according to FIG. 1.
Figure 3:
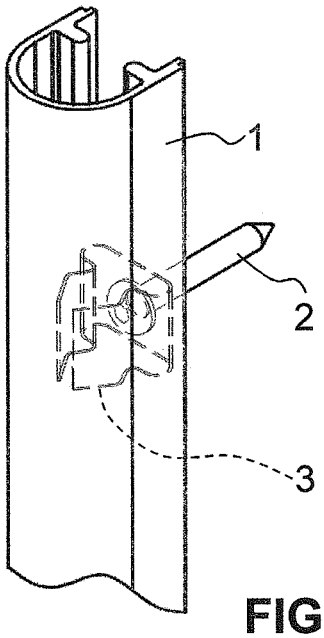
FIG. 3 shows the part of the finger protection device according to FIG. 2 in the assembled state.
Figure 4:
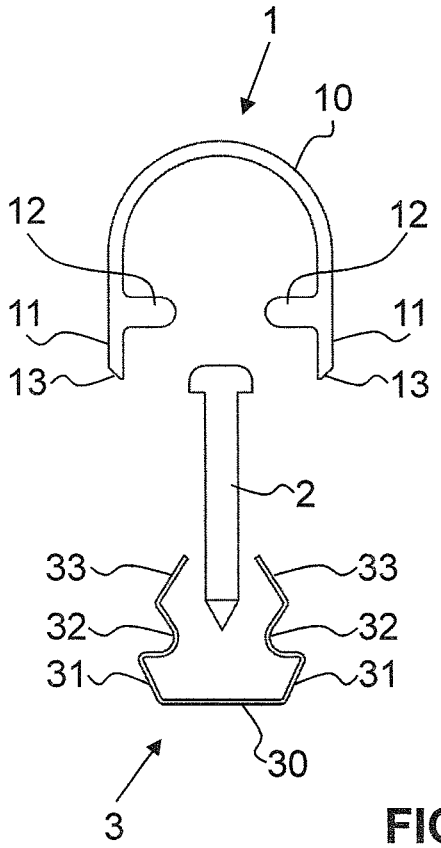
FIG. 4 shows a view of the finger protection device according to FIG. 1 in an exploded view.
Figure 5:
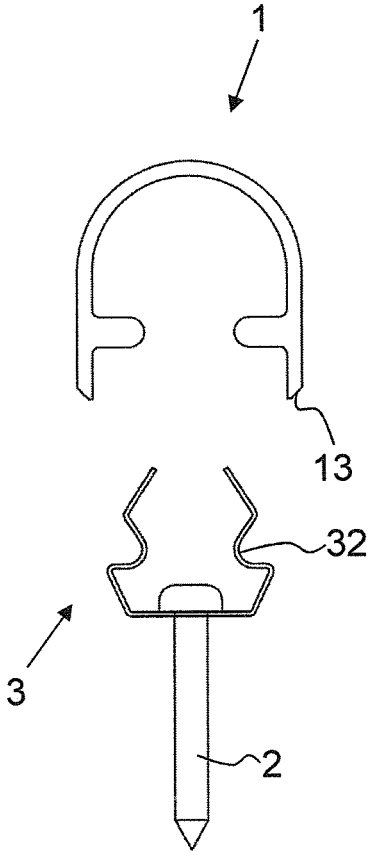
FIG. 5 shows the finger protection device according to FIG. 4 in the partially assembled state.

FIG. 1 shows a part of a leaf door with a door leaf F, door frame R and a hinge B, also called the door hinge or door pivot. A wall adjacent to the door frame R is provided with the reference numeral W.

The hinge B has a hinge upper part, a hinge lower part and a pivot pin shown in dashed lines in FIG. 1. The hinge upper part is fastened to the door leaf, also called the door leaf. The hinge lower part is fastened to the door frame, also called the frame or jamb. Generally, a door has two such hinges B which are arranged so as to be distributed along the height of the door.

The finger protection device is arranged below the lower hinge B shown here, between the two hinges and above the upper hinge. The finger protection device has a corresponding number of protective profiles 1 and clips 3 for fastening the protective profiles 1.

The protective profiles 1 are preferably shaped such that they form a curved surface which is aligned with the hinge B. In other words, the surfaces thereof are preferably aligned in all vertical planes with the hinge surface.

It is also possible for fewer finger protection devices to be used. In other words, it is possible to protect, for example, only the region below the lower hinge B and/or the region between the two hinges. If the finger protection device is used in a plurality of regions, its parts are preferably configured to be identical except for the length and the number of clips to be used.

The finger protection device prevents access to the gap which is produced between the door leaf F and the door frame R when opening the door leaf F. This primarily applies to rebated doors as is shown by way of example in FIG. 1.

In FIGS. 2 to 6 the finger protection device according to the invention is shown in detail. The protective profile 1 is preferably produced from a metal or a plastics material. The protective profile is preferably configured to be stiff or approximately stiff. Approximately stiff means that it is only able to bend slightly when plugged onto the clip and/or when released from the clip but the clip produces the action of force.

The protective profile 1 has a substantially U-shaped cross section with a curved rear portion. The protective profile is preferably configured to be axially symmetrical relative to its longitudinal central axis L. The protective profile has a base body 10, two inwardly oriented ribs 12 and one respective limb 11 adjacent to the ribs 12. The limbs 11 terminate freely, wherein the free ends are provided with a chamfer 13. The chamfers 13 are inclined inwardly as may be clearly seen in FIGS. 4 to 6. In the view according to FIGS. 2 and 3, instead of the chamfer 13 a step is shown, wherein the longer region of the limbs 11 also extends inwardly.

The ribs 12 preferably extend over the entire length of the protective profile 1. As a result, the protective profile 1 may be produced by the meter and may be shortened to the desired length for use.

The ribs 12 are preferably configured to be thicker and thus more stable than the wall of the remaining protective profile 1. Preferably, the base body 10 has a uniform wall thickness. Preferably, the limbs 11 are of the same thickness as the wall of the base body 10.

The clip 3 is preferably produced from metal, in particular from spring steel. The clip is of resilient configuration.

The clip 30 has a planar base 30 with which the clip 3 in the mounted state bears against the surface of the door frame R. This base 30 preferably has one or more through-openings which are not visible in the figures. This through-opening serves for fastening the clip 3 to the frame R. The fastening element which is used to this end in the example is a screw 2. Alternatively or additionally, nails or other fastening elements may also be used.

The base 30 transitions on two opposing sides integrally into first oblique limbs 31. These limbs terminate in receiver recesses 32 oriented inwardly and open outwardly, which in turn transition integrally into second oblique limbs 33.

The first limbs 31 are inclined obliquely outwardly, the second limbs 33 are inclined obliquely inwardly. The angles of the inclinations of the first and second limbs 31, 33 are preferably variable. Preferably, the angle of inclination of the second limbs 33 is greater than that of the first limbs 31.

Figure 6:
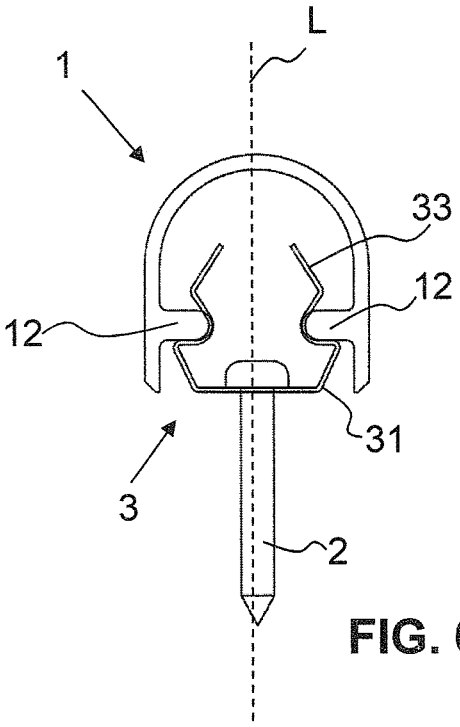
FIG. 6 shows the finger protection device according to FIG. 4 in the assembled state.

The receiver recesses 32 serve for receiving the ribs 12, as may be clearly seen in FIG. 6. The receiver recesses 32 have in the lower region an approximately horizontally extending bottom surface, against which the rib 12 comes to bear. The upper region of the receiver recesses 32 is preferably inclined obliquely upwardly in order to simplify the insertion into the recesses 32 and also the removal of the ribs 12 from the recesses 32.

The recesses 32 are pressed slightly inwardly when the protective profile 1 is plugged on, and the clips are slightly compressed. Due to the resilient restoring force, the protective profile 1 is releasably held on the clip 3.

By tilting the protective profile 1 slightly in one direction, one of the ribs 12 may be released from the receiver recess 32 of the clip 3 and the protective profile 1 may be easily removed again.

Figure 7A:
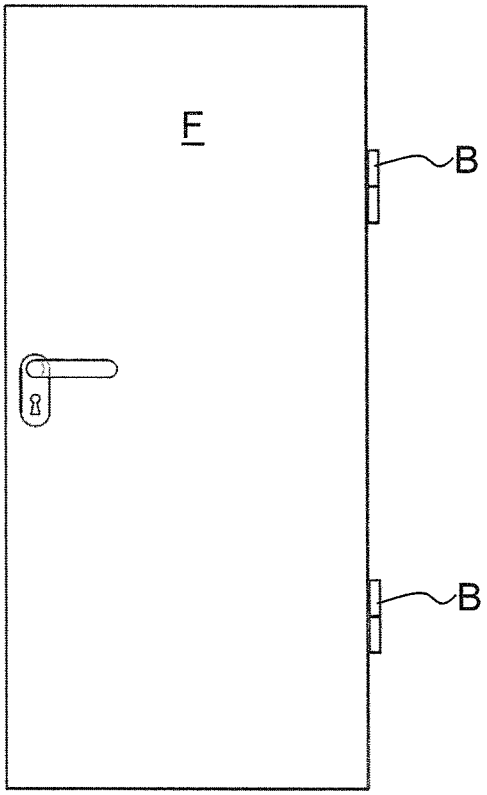
FIG. 7*a* shows a side view of a leaf door in the closed state and without the finger protection device.
Figure 7B:
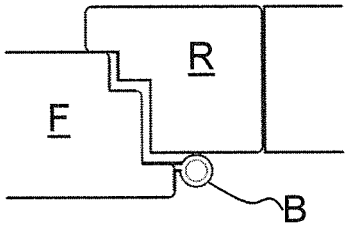
FIG. 7*b* shows a view of the leaf door according to FIG. 7*a* from above.
Figure 8A:
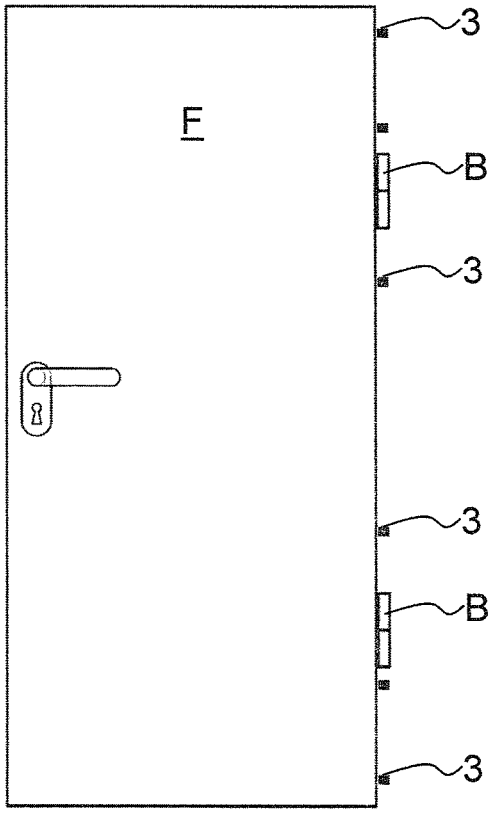
FIG. 8*a* shows a side view of the leaf door according to FIG. 7*a* with the mounted clips of the finger protection device.
Figure 8B:
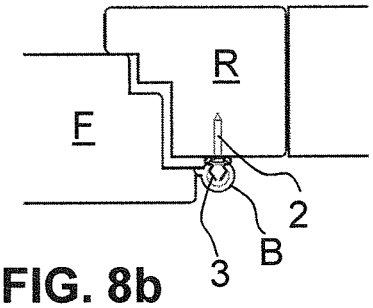
FIG. 8*b* shows a view of the leaf door according to FIG. 8*a* from above.
Figure 9A:
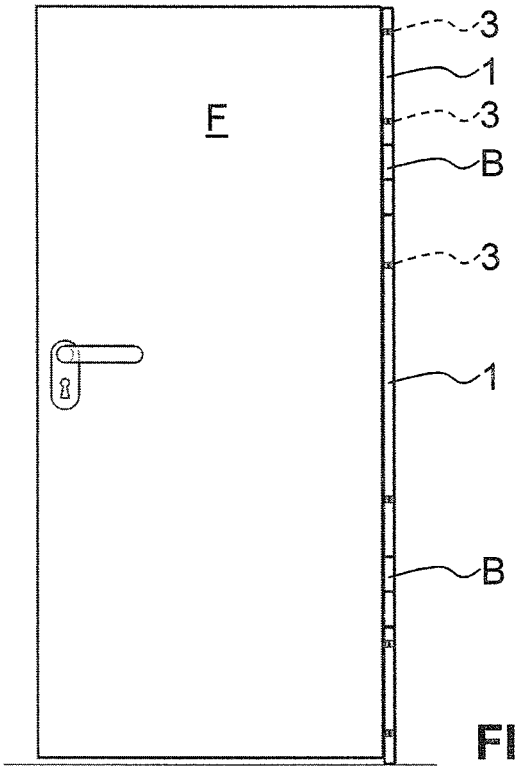
FIG. 9*a* shows a side view of the leaf door according to FIG. 7*a* with the mounted finger protection device and FIG. 9*b* shows a view of the leaf door according to FIG. 9*a* from above.
Figure 9B:
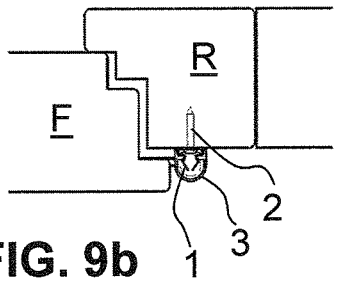

In FIGS. 7*a* to 9*b*, the individual steps of mounting the finger protection device are shown. FIGS. 7*a* and 7*b* show the situation before the finger protection device is mounted. In FIGS. 8*a* and 8*b*, the clips 3 are mounted. In FIGS. 9*a* and 9*b*, the protective profiles 1 are plugged on.

The hinge-sided finger protection device according to the invention may be easily mounted and removed again.

LIST OF REFERENCE NUMERALS

1 Protective profile
10 Base body
11 Limb
12 Rib
13 Chamfer/step
2 Screw
3 Clip
30 Base
31 First limb
32 Receiver recess
33 Second limb
B Hinge
F Door leaf
L Longitudinal central axis
R Door frame
W Wall

The invention claimed is:

1. A hinge-sided finger protection device for a leaf door, the leaf door having a door frame, a door leaf and at least one hinge connecting the door leaf to the door frame, wherein the finger protection device comprises at least one protective profile and at least one fastening means for fastening the protective profile to the door frame of the leaf door, wherein the protective profile is configured to be approximately stiff or stiff and wherein the protective profile can be plugged onto the fastening means and wherein the protective profile accommodates in itself the fastening means in the plugged-on state, wherein the protective profile is non-destructively removable from the fastening means and can be again plugged thereon, wherein the at least one fastening means is a clip, wherein the clip is configured to be resilient, wherein the clip has a planar base which on two opposing sides transitions into one respective first limb, wherein each first limb transitions into an inwardly extending receiver recess, and wherein each receiver recess transitions into one respective second limb terminating freely, wherein the receiver recesses form openings which are inclined obliquely upwardly, wherein the two first limbs open obliquely outwardly from the base, wherein the protective profile has two inwardly protruding ribs for engaging in the receiver recesses, wherein the protective profile has two opposing limbs terminating freely, wherein the limbs of the protective profile protrude over the ribs and wherein the limbs of the protective profile extend at a distance to the first limbs of the clip.

2. The finger protection device as claimed in claim 1, wherein the clip is configured to be axially symmetrical in cross section.

3. The finger protection device as claimed in claim 1, wherein the two second limbs of the clip are inclined obliquely inwardly toward a longitudinal central axis.

4. The finger protection device as claimed in claim 1, wherein the two receiver recesses are arranged at the same height relative to the base.

5. The finger protection device as claimed in claim 1, wherein the protective profile is configured to be axially symmetrical in cross section.

6. The finger protection device as claimed in claim 1, wherein the protective profile is produced from metal or plastics material.

7. The finger protection device as claimed in claim 1, wherein the limbs of the protective profile have free ends which have one respective chamfer, which is inclined toward the planar base or thinned, or a tapering or a step.

* * * * *